United States Patent [19]

Brown

[11] 4,052,574

[45] Oct. 4, 1977

[54] PRESSURE SWITCH WITH SNAP-TOGGLE ADJUSTING MEANS

[75] Inventor: Harry W. Brown, Big Bend, Wis.

[73] Assignee: Cutler-Hammer, Inc., Milwaukee, Wis.

[21] Appl. No.: 697,210

[22] Filed: June 17, 1976

[51] Int. Cl.[2] ..... H01H 35/34

[52] U.S. Cl. ..... 200/83 P; 200/83 SA

[58] Field of Search ..... 200/83 P, 83 S, 83 SA, 200/81 R, 82 R

[56] References Cited

U.S. PATENT DOCUMENTS

| | | | |
|---|---|---|---|
| 2,281,544 | 5/1942 | Beeman et al. | 200/83 SA |
| 2,412,095 | 12/1946 | Muerle | 200/83 P |
| 2,790,044 | 4/1957 | Booth | 200/835 |
| 3,046,368 | 7/1962 | Kaminky | 200/83 P |

*Primary Examiner*—Gerald P. Tolin

*Attorney, Agent, or Firm*—Hugh R. Rather; William A. Autio; Michael E. Taken

[57] ABSTRACT

A snap-action pressure switch has an adjustable trip point for controlling the switching pressure. A flexible bracket has a bearing portion pivotally mounting a lever between the ends thereof. Contact means are actuated by one end of the lever. A toggle spring is biased between the other end of the lever and a pressure-responsive actuator for causing snap-action pivoting of the lever when the toggle spring passes through an over-center force-reversing toggle point as the actuator moves in response to pressure. The bearing portion of the flexible bracket is adjustably movable with respect to the actuator, thus moving the pivot point of the lever to change the toggle point of the spring with respect to movement of the actuator, whereby to afford an adjustable switching pressure. The trip point is further controlled by an adjustble range spring biasing the actuator against pressure-induced movement.

8 Claims, 4 Drawing Figures

Fig. 3
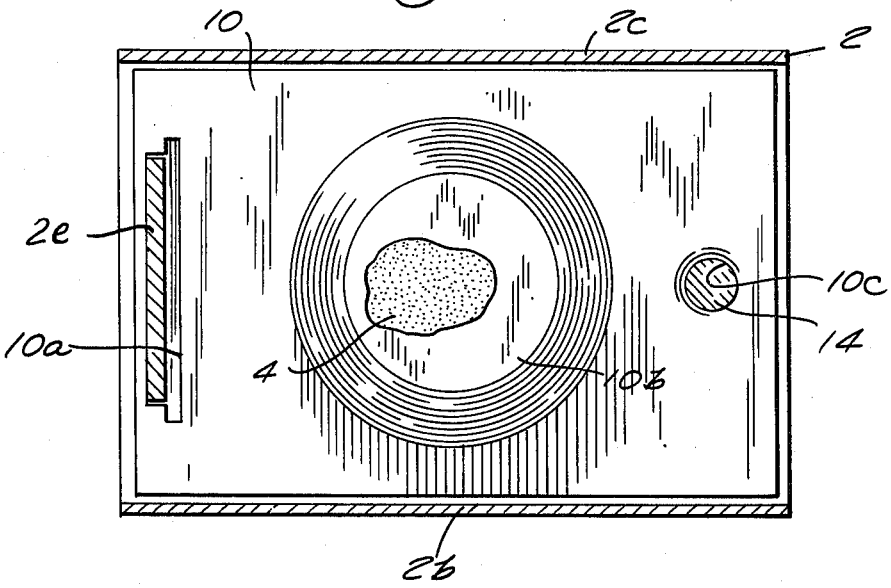
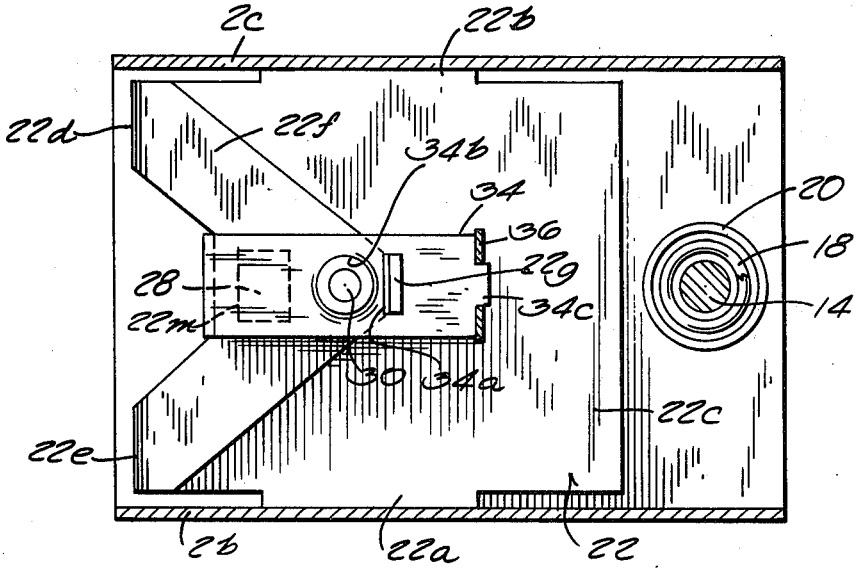
Fig. 4

PRESSURE SWITCH WITH SNAP-TOGGLE ADJUSTING MEANS

BACKGROUND OF THE INVENTION

Snap-action pressure switches having an adjustable switching pressure are known in the art. While these switches have been useful for their intended purposes, the present invention relates to improvements thereover.

SUMMARY OF THE INVENTION

An object of the invention is to provide an improved snap-action pressure switch having an accurately controllable switching pressure.

Another object is to provide a switch of the aforementioned character having a minimum number of parts, and which is economical to manufacture and reliable in operation.

Another object is to provide a switch of the aforementioned character having dual adjustment means, one for controlling the pressure at which an actuator will start to move and another for controlling the trip point with respect to such movement.

Another object of the invention is to provide a switch of the aforementioned character having a bearing pivotally mounting a lever, a toggle spring biased between the lever and the actuator, and means for adjustably moving the bearing relative to the actuator whereby to vary the toggle point of the toggle spring relative to pressure-induced actuator movement.

A specific object of the invention is to provide a switch of the aforementioned character which may be used for domestic water pump control and which has an operating pressure range of 20 to 40 pounds per square inch.

Other objects and advantages will hereinafter appear.

BRIEF DESCRIPTION OF THE DRAWINGS

FIG. 3 is a cross-sectional view taken along line 3—3 of FIG. 1.

FIG. 4 is a cross-sectional view taken along line 4—4 of FIG. 1.

DESCRIPTION OF THE PREFERRED EMBODIMENT

Figure 1:
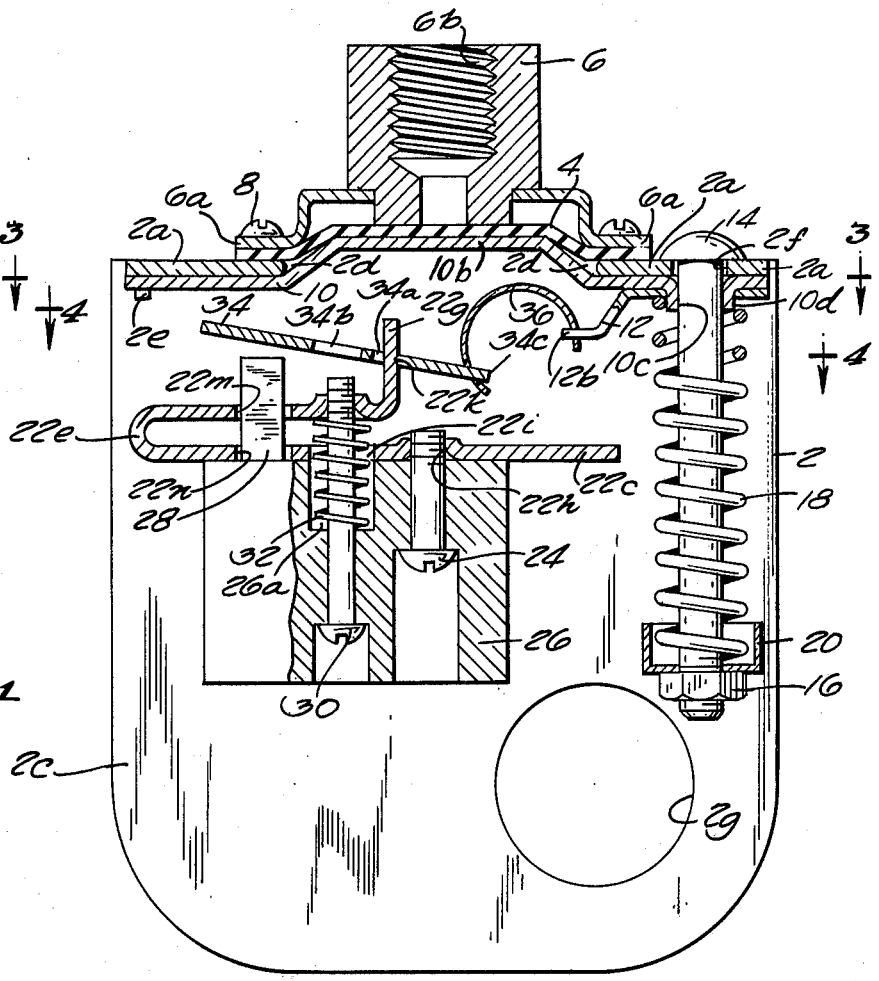
FIG. 1 is a cross-sectional view of the preferred form of the present invention.

There is shown in FIG. 1 a snap-action pressure switch constructed in accordance with the invention. A metal housing 2 has a rectangular top wall 2*a* and two opposed U-shaped walls 2*b* and 2*c* extending perpendicularly therefrom, back wall 2*c* is shown in FIG. 1. Each wall is provided with an access hole 2*g*. The housing is open at the bottom and the left and right sides, and may be closed by a U-shaped cover (not shown) complemental to the housing and mounted thereto from below.

Top wall 2*a* has a circular aperture 2*d* formed centrally therethrough over which a pressure-responsive element, such as a rubber diaphragm 4, is mounted. A metal bushing 6 is mounted over the diaphragm at lower flange portion 6*a* by means of screws 8, or the like, extending through the flange, the diaphragm and the top wall of the housing along the periphery of aperture 2*d* for tightly sealing the diaphragm between the housing and the bushing. The bushing has a central longitudinal bore 6*b* extending therethrough to communicate with the diaphragm and may be threaded to facilitate mounting to a pressure source, such as a water tank.

The switch is provided with actuator means, comprising a power plate 10 and a connecting arm 12, movable by the diaphragm in response to pressure-responsive flexing thereof. The power plate is a rectangular member generally coextensive with and underlying top wall 2*a*. The plate has an elongated slot 10*a* formed therethrough adjacent the left side thereof, FIG. 3, which receives a downwardly curled elongated retaining lip 2*e* of the top wall for hingedly mounting the power plate. The plate has a central raised annular portion 10*b* extending up through aperture 2*d* and abutting the diaphragm. An extruded hole 10*c* is formed in the plate by flange portion 10*d* thereof. Arm 12 has a circular aperture 12*a* encircling flange 10*d* such that the arm may abutt the underside of the power plate as shown in FIG. 1.

Extending through an aperture 2*f* in the top wall of the housing and through hole 10*c* is a range screw 14 having a threaded lower portion for receiving a range nut 16. A helical compression spring 18 encircles screw 14, bearing at one end against arm 12 and at the other end against an apertured retaining cup 20 slidably fitted around the screw and stopped against the range nut. The actuator means is thus biased upwardly, FIG. 1, against pressure-induced downward flexing of the diaphragm.

Figure 2:
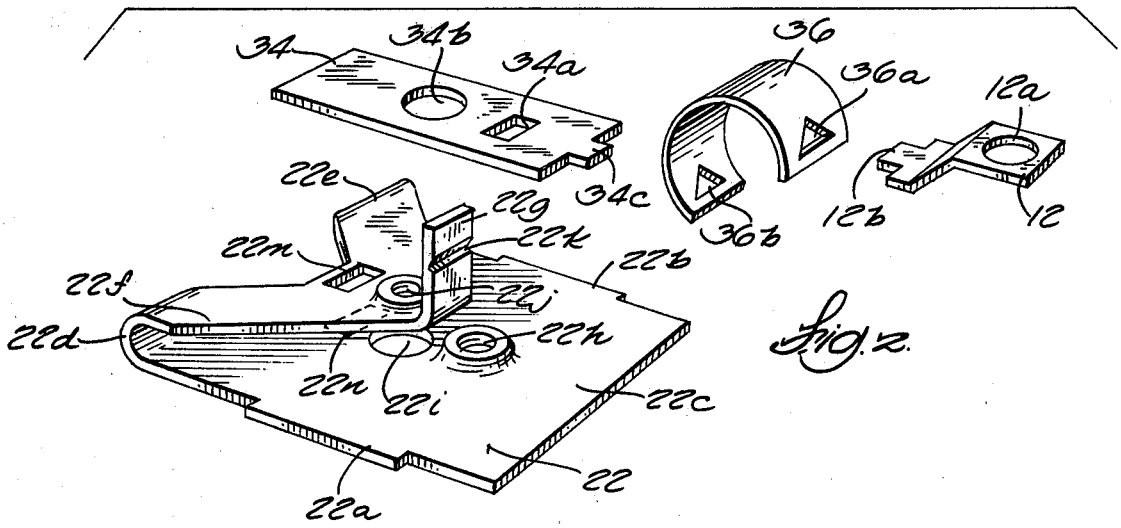
FIG. 2 is an isometric view of separated isolated parts of FIG. 1.

A flexible metal bracket 22 is mounted between the front and back walls of the housing by elongated laterally protruding shoulder portions 22*a* and 22*b*, FIGS. 2 and 4, fitting into complementary slots formed in front and back walls 2*b* and 2*c*. The bracket has a lower generally planar portion 22*c* and is bent back over itself and slotted at the end to form two flexible U-shaped bends 22*d* and 22*e* separated by a frusto-V-shaped slot. An upper generally V-shaped portion 22*f* has an upstanding bearing portion 22*g* extending perpendicularly from the yoke thereof.

The bracket has an extruded threaded hole 22*h* in lower portion 22*c* which receives a mounting screw 24 for rigidly mounting a contact enclosure 26 against the underside of the bracket. Slidably mounted in the enclosure for up-down movement, FIG. 1, is a plunger 28 which extends up through holes 22*m* and 22*n* in upper and lower portions 22*f* and 22*c* of the bracket. This plunger is arranged to actuate a set of contacts within the enclosure.

The bracket has an aperture 22*i* in lower portion 22*c* in alignment with a smaller diametered extruded threaded hole 22*j* in upper portion 22*f*. An adjustment screw 30 extends through enclosure 26 and aperture 22*i* to be threadingly received in hole 22*j*. The enclosure has a bore 26*a*, FIG. 1, formed in alignment with aperture 22*i* for receiving a helical compression spring 32 encircling the adjustment screw and bearing at one end against the underside of upper portion 22*f* of the bracket and at the other end against the bottom of bore 26*a* to bias the upper portion of the bracket upwardly. Adjustment screw 30 is accessible from below and may be turned in either direction whereby to raise or lower bearing portion 22*g* of the bracket.

Bearing portion 22*g* of the bracket has a V-shaped notch 22*k* formed thereacross to act as a bearing and pivot point for pivotally mounting an elongated planar lever 34 between the ends thereof. The lever has a rectangular aperture 34a therein, one side of which bears against notch 22k under the influence of the bias provided by toggle spring 36, as will be more fully described hereinafter. The lever has a circular aperture 34b to allow clearance therethrough of the threaded end of adjustment screw 30 during pivoting of the lever about notch 22k. When the lever pivots counterclockwise, FIG. 1, the left end thereof will strike plunger 28 and drive it downwardly to actuate the contacts in enclosure 26.

A toggle spring, such as resilient arcuate member 36, is biased between connecting arm 12 and lever 34. The toggle spring has triangular apertures 36a and 36b near the ends thereof for loosely receiving nibs 12b and 34c of the arm and lever respectively. The toggle spring is under slight compression and thus biases the lever leftwardly, FIG. 1, so that the edge of aperture 34a is held in bearing notch 22k.

It is to be noted that the invention is not to be limited to the particular type of toggle spring shown, as any type of biasing means having an overcenter force-reversing characteristic may be used. For example, a helical compression spring biased between the lever and the arm may be used.

Operation of the switch can now be described. Bushing 6 can be screwed to a fitting on a water tank, for example. The water pressure forces diaphragm 4 against power plate 10 which is restrained by range spring 18. As the water pressure rises, it reaches a point where the power plate force balances the range spring force. Further increase in water pressure moves the power plate and thus arm 12 which is trapped between the power plate and the range spring. The motion of the arm biases the toggle spring which in turn biases lever 34. At some point during the downward movement of the arm, the toggle spring passes through an overcenter toggle point reversing the direction of force on the lever, causing rapid pivoting of the lever on bearing notch 22k thereby driving plunger 28 downwardly to open the contacts, for example. The reverse conditions prevail when the water pressure is lowered resulting in a return to the original position, FIG. 1, of the lever, allowing the contacts to reclose.

The flexible end, 22d and 22e, of the bracket allows adjustment of the bearing relative to the arm thereby varying the toggle point of the toggle spring relative to movement of the arm. Adjustment of range nut 16 determines the water pressure necessary to balance the restraining force of range spring 18 and thus the water pressure at which the actuator means (power plate 10 and arm 12) will move. By alternate adjustment of range nut 16 and screw 30, it is possible to set the cut-in and cut-out pressure within a narrow range.

It is thus seen that the present invention affords dual adjustment of the switching pressure. Adjustment of range nut 16 controls movement of the actuator means with respect to pressure, and adjustment of screw 30 controls the toggle point of spring 36 with respect to such movement of the actuator means (by moving the pivot point of the lever).

The terms and expressions used herein are of description, not limitation, and there is no intention in the use of such terms and expressions of excluding any equivalents of any of the features shown, or described, or portions thereof, and it is recognized that various modifications are possible within the scope of the appended claims.

I claim:

1. A pressure switch comprising:

a housing;

pressure responsive means mounted to said housing for movement relative thereto in response to pressure;

actuator means mounted in said housing and movable by said pressure responsive means;

a bearing movably mounted in said housing;

a lever pivotally mounted between its ends at said bearing;

contact means mounted in said housing for actuation by one end of said lever in response to pivoting thereof;

a toggle spring biased between said actuator means and the other end of said lever to cause snap-action pivoting of said lever as said toggle spring passes through an overcenter force-reversing toggle point in response to movement of said actuator means; and adjusting means for moving said bearing relative to said actuator means, thereby varying the toggle point of said toggle spring relative to movement of said actuator means whereby to adjustably control the pressure at which said contact means is actuated.

2. The switch according to claim 1 further comprising biasing means adjustably biasing said actuator means against pressure-induced movement by said pressure responsive means to thereby adjustably control movement of said actuator means relative to pressure whereby to further control the pressure at which said contact means is actuated.

3. The switch according to claim 2 wherein said adjusting means comprises a flexible bracket mounted in said housing and having a bearing portion disposing said bearing and movable upon flexure of said bracket, and means for flexing said bracket.

4. The switch according to claim 3 wherein said bracket has a U-shaped flexible bend, one leg of the U being stationary and rigidly mounted in the housing, the other leg of the U being movable towards and away from said one leg upon flexure of said U-shaped bend, said bearing portion extending from said other leg.

5. The switch according to claim 4 wherein said bearing portion extends laterally from said other leg; said bearing comprises a notch formed in said bearing portion, and said lever has an aperture therein between the ends thereof through which said bearing portion extends, one side of said aperture engaging said notch and biased thereagainst by said toggle spring for pivotal movement thereabout.

6. The switch according to claim 5 wherein said other leg of said U has a threaded aperture therein in alingment with an aperture in said one leg of said U, and wherein said means for flexing said bracket comprises means biasing said legs away from each other and a screw fixed at one end with respect to said housing and extending slidably through said last mentioned aperture into threaded engagement with said aperture in said other leg for moving said other leg towards or away from said one leg upon turning of said screw.

7. The switch according to claim 6 wherein said contact means comprises a plunger depressible in a direction generally parallel to said bearing portion through holes formed in said legs, and a set of contacts actuated by depression of said plunger, said plunger being depressed by said one end of said lever having a second aperture to allow clearance therethrough of said screw during pivoting of said lever.

8. The switch according to claim 2 wherein said actuator means comprises a power plate hingedly mounted at one end to said housing and having a middle portion abuttingly facing said pressure responsive means, and an arm extending from the other end of said power plate to engage said toggle spring, and wherein said biasing means comprises a range spring having one end adjustably mounted in said housing and the other end bearing against said arm and said other end of said power plate.

* * * * *